US010562319B2

(12) United States Patent
Matsuoka

(10) Patent No.: US 10,562,319 B2
(45) Date of Patent: Feb. 18, 2020

(54) INK DRYING DEVICE AND PRINTING SYSTEM

(71) Applicant: Roland DG Corporation, Hamamatsu-shi, Shizuoka (JP)

(72) Inventor: Hisaya Matsuoka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 3 days.

(21) Appl. No.: 15/927,121

(22) Filed: Mar. 21, 2018

(65) Prior Publication Data

US 2018/0272754 A1 Sep. 27, 2018

(30) Foreign Application Priority Data

Mar. 22, 2017 (JP) ..... 2017-055539

(51) Int. Cl.

| | |
|---|---|
| ***B41J 11/00*** | (2006.01) |
| ***B41J 2/32*** | (2006.01) |
| ***B41J 11/057*** | (2006.01) |
| ***B41J 11/06*** | (2006.01) |

(52) U.S. Cl.

CPC ..... *B41J 11/002* (2013.01); *B41J 2/32* (2013.01); *B41J 11/057* (2013.01); *B41J 11/06* (2013.01)

(58) Field of Classification Search

CPC .... B41J 11/002; B41J 11/0015; B41J 29/377; B41J 11/06; B41J 11/02; B41J 11/00; B41J 2/32; B41J 11/057

See application file for complete search history.

(56) References Cited

U.S. PATENT DOCUMENTS

2011/0242164 A1* 10/2011 Miura ..... B41J 11/002 347/9
2015/0022601 A1 1/2015 Ohnishi
2016/0332464 A1* 11/2016 Harayama ..... B41J 11/002

FOREIGN PATENT DOCUMENTS

JP 2013-184383 A 9/2013

* cited by examiner

*Primary Examiner* — Jannelle M Lebron
(74) *Attorney, Agent, or Firm* — Keating & Bennett, LLP

(57) ABSTRACT

An ink drying device dries ink injected onto a recording medium. The ink drying device includes a main body including a counter plate facing the recording medium and including an inner space, and a heat generator located in the inner space of the main body to generate heat. The counter plate is provided with a plurality of discharge holes. The ink drying device further includes a heat diffusion layer provided on an outer surface of the counter plate that faces the recording medium.

15 Claims, 13 Drawing Sheets

INK DRYING DEVICE AND PRINTING SYSTEM

CROSS REFERENCE TO RELATED APPLICATIONS

This application claims the benefit of priority to Japanese Patent Application No. 2017-055539 filed on Mar. 22, 2017. The entire contents of this application are hereby incorporated herein by reference.

BACKGROUND OF THE INVENTION

1. Field of the Invention

The present invention relates to an ink drying device and a printing system.

2. Description of the Related Art

Conventionally, a printing device represented by, for example, an inkjet printer is known. This type of printing device includes, for example, a platen on which a recording medium is to be placed, and an ink head that injects ink toward the recording medium placed on the platen.

For example, Japanese Laid-Open Patent Publication No. 2013-184383 discloses an inkjet recording device including a heater that heats a platen. In the recording device disclosed in Japanese Laid-Open Patent Publication No. 2013-184383, the platen is heated by the heater, and thus the recording medium placed on the platen is heated. This promotes drying of ink injected onto the recording medium. As a result, the ink injected onto the recording medium is dried quickly.

As a recording medium on which printing is to be performed, a relatively thick recording medium may be used. In the case where the recording device disclosed in Japanese Laid-Open Patent Publication No. 2013-184383 performs printing on a relatively thick recording medium, it may be difficult for the heat of the platen heated by the heater to be transmitted to a surface of the recording medium. In this case, the drying of the ink injected onto the recording medium may not be promoted.

SUMMARY OF THE INVENTION

Preferred embodiments of the present invention provide ink drying devices capable of promoting drying of ink injected onto a recording medium, and printing systems including such recording devices.

An ink drying device according to a preferred embodiment of the present invention dries ink injected onto a recording medium. The ink drying device includes a main body and a heat generator. The main body includes a counter plate facing the recording medium and including an inner space. The heat generator is located in the inner space of the main body and generates heat. The counter plate is provided with a plurality of discharge holes. The ink drying device further includes a heat diffusion layer provided on an outer surface of the counter plate facing the recording medium.

With the ink drying device, heat generated by the heat generator is discharged, together with air, via the discharge holes in the counter plate to the outside of the main body. The heat discharged to the outside of the main body is diffused by the heat diffusion layer and reaches the ink injected onto the recording medium. As a result, the ink injected onto the recording medium is directly dried by the heat diffused by the heat diffusion layer. Therefore, even if the recording medium is relatively thick, the ink is dried efficiently by the heat diffused by the ink diffusion layer. This prevents the drying of the ink from becoming difficult due to, for example, the thickness of the recording medium.

Preferred embodiments of the present invention promote drying of ink injected onto a recording medium.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, printing systems including ink drying devices and printing devices according to preferred embodiments of the present invention will be described with reference to the drawings. The preferred embodiments described below are not intended to specifically limit the present invention. Components and portions that have the same functions will bear the same reference signs, and overlapping descriptions will be omitted or simplified optionally.

Preferred Embodiment 1

Figure 1:
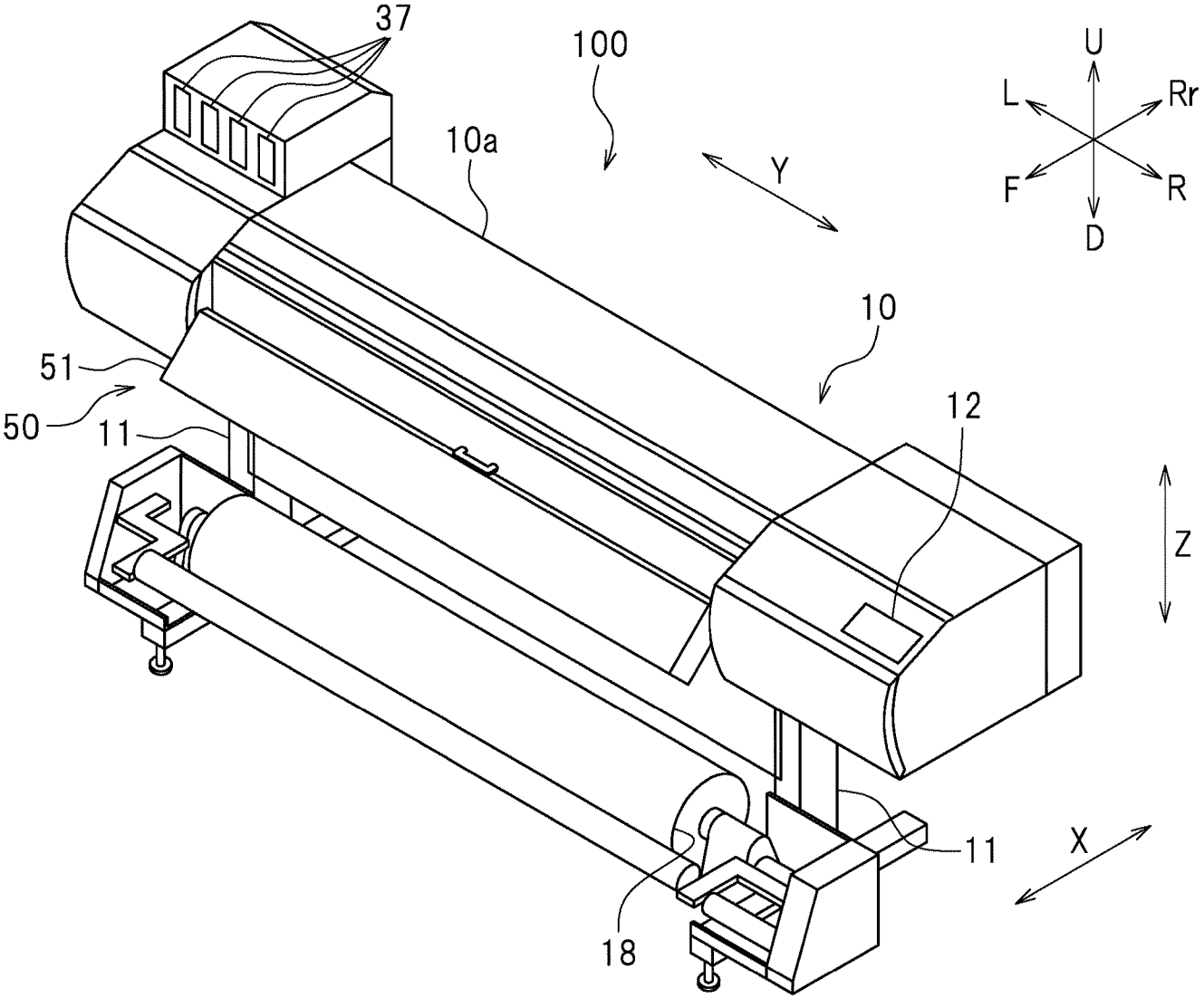
FIG. 1 is a perspective view of a printing system according to preferred embodiment 1 of the present invention.

FIG. 1 is a perspective view of a printing system 100 according to this preferred embodiment. In the following description, directions are defined as follows with respect to a user in front of the printing system 100: a direction approaching the user from the printing system 100 is defined as "forward", and a direction spaced from the user toward the printing system 100 is defined as "rearward". The terms "left", "right", "up" and "down" refer to left, right, up and down with respect to the printing system 100 as seen in a front view thereof. In the drawings, letters F, Rr, L, R, U and D respectively represent "front", "rear", "left", "right", "up" and "down". In the drawings, letter "Y" represents a main scanning direction. Herein, the main scanning direction Y is a left-right direction. Letter "X" represents a sub scanning direction. Herein, the sub scanning direction is a front-rear direction. The sub scanning direction X is perpendicular to the main scanning direction Y as seen in a plan view. Letter "Z" represents a height direction, namely, an up-down direction. In this preferred embodiment, the main scanning direction Y corresponds to a "first direction". The sub scanning direction X corresponds to a "second direction". In this preferred embodiment, a rear side in the sub scanning direction X is referred to as "upstream". A front side in the sub scanning direction X is referred to as "downstream". These directions are provided merely for the sake of convenience, and do not limit the manner of installation of the printing system 100, and thus do not limit the present invention in any way.

In this preferred embodiment, as shown in FIG. 1, the printing system 100 injects ink toward a recording medium 5 (see FIG. 2) to perform printing. The printing system 100 dries the ink injected onto the recording medium 5. The printing system 100 includes a printing device 10 and an ink drying device 50.

Figure 2:
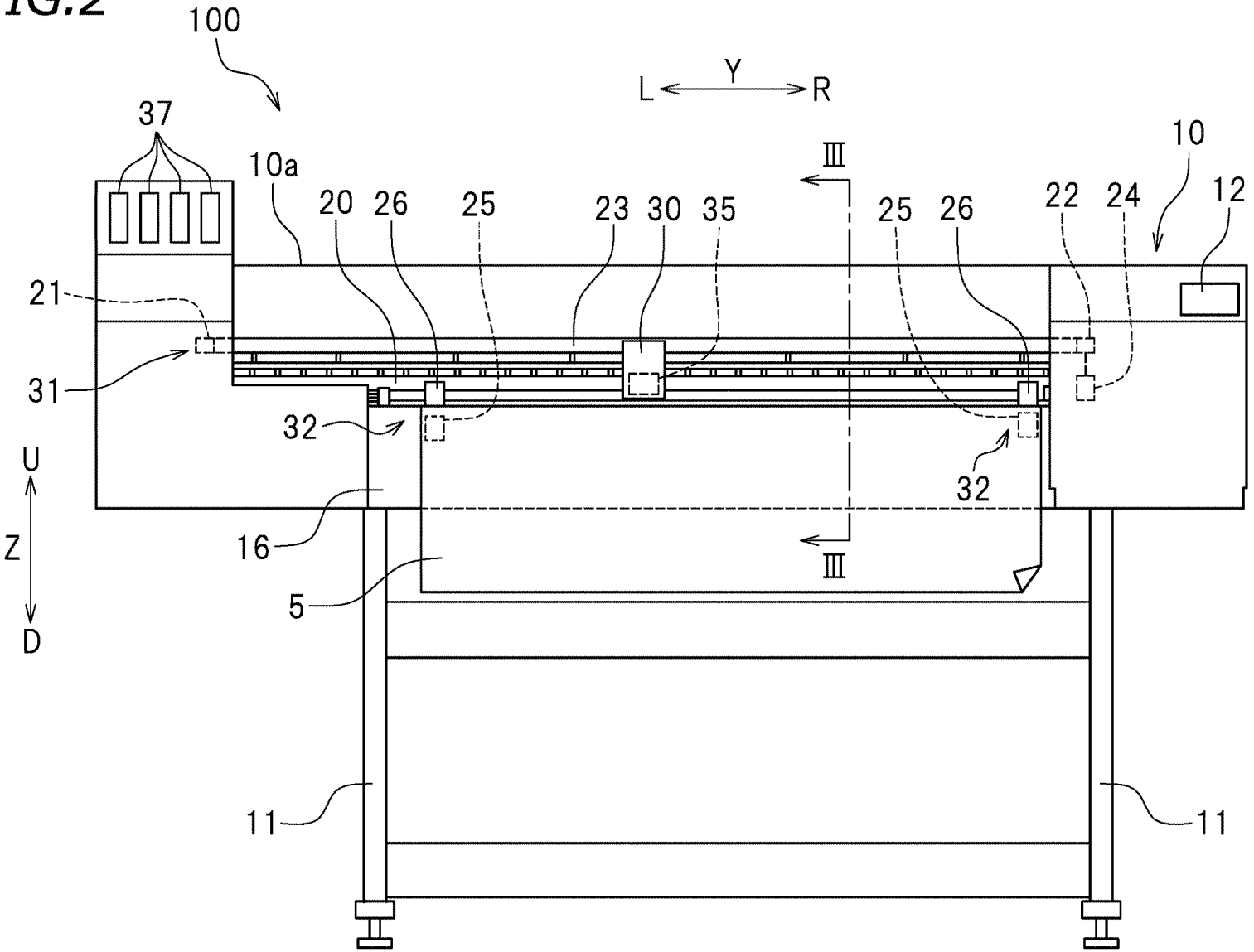
FIG. 2 is a front view of a printing device.
Figure 3:
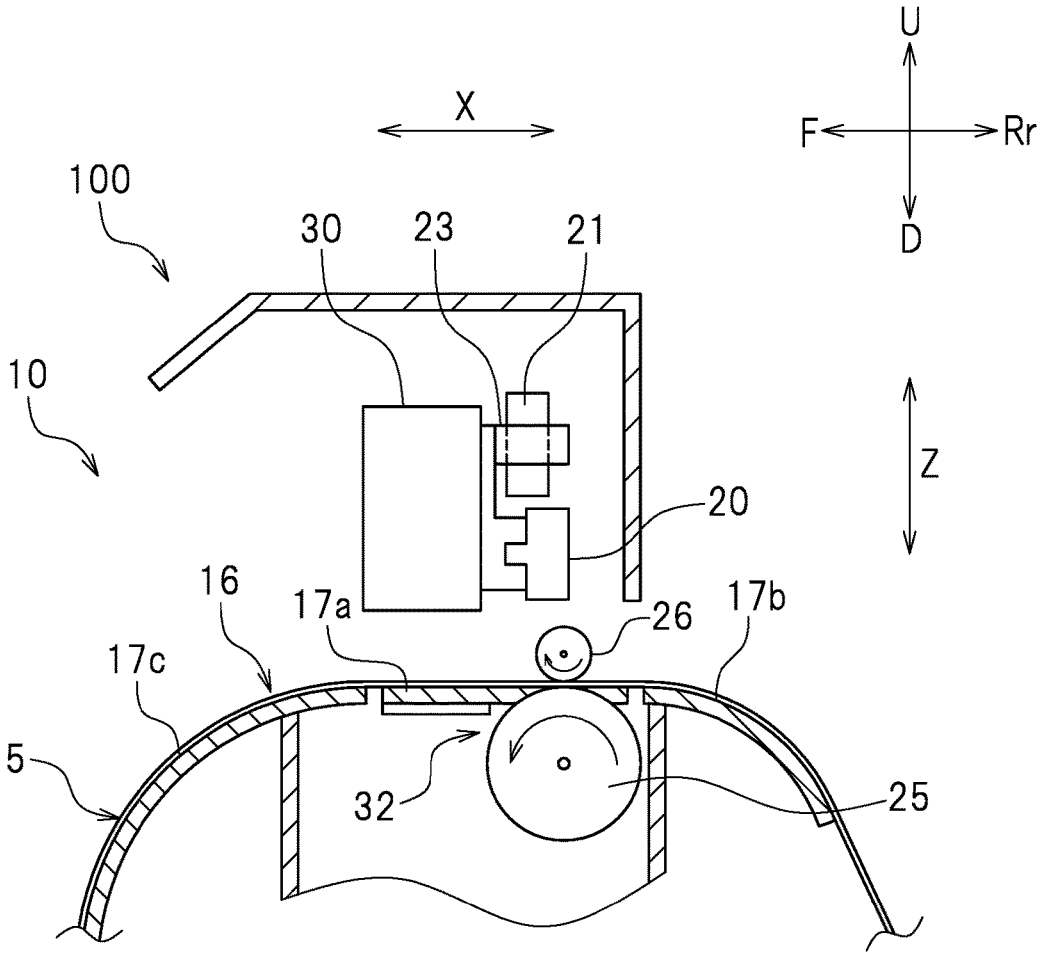
FIG. 3 is a cross-sectional view taken along line III-III in FIG. 2.

FIG. 2 is a front view of the printing device 10. FIG. 3 is a cross-sectional view taken along line III-III in FIG. 2. FIG. 2 and FIG. 3 omit the ink drying device 50. As shown in FIG. 2, the printing device 10 is a device that injects ink toward the recording medium 5 to perform printing on the recording medium 5. In this example, the printing device 10 is an inkjet printer. In this preferred embodiment, the printing device 10 is longer in the main scanning direction Y than a home-use printer. The printing device 10 is a so-called large-scale printer. The printing device 10 is, for example, a business-use printer. The printing device 10 sequentially moves the recording medium 5, which is of a rolled type, forward (in this example, downstream in the sub scanning direction X) while injecting ink from an ink head 35 moving in the main scanning direction Y to print an image on the recording medium 5. The recording medium 5 is a target on which an image is to be printed. There is no specific limitation on the type of the recording medium 5. The recording medium 5 may be, for example, paper such as plain paper, inkjet printing paper or the like. Alternatively, the recording medium 5 may be a transparent sheet formed of a resin such as polyvinyl chloride (PVC), polyester or the like or formed of glass. The recording medium 5 may be a sheet formed of a metal material, rubber or the like. The recording medium 5 may be relatively thick.

As shown in FIG. 2, the printing device 10 includes a printer main body 10*a*, legs 11, and an operation panel 12. The printer main body 10*a* includes a casing extending in the main scanning direction Y. The legs 11 support the printer main body 10*a*. The legs 11 are provided on a bottom surface of the printer main body 10*a*. The operation panel 12 is provided, for example, in a right portion of a front surface of the printer main body 10. There is no specific limitation on the position of the operation panel 12. The operation panel 12 allows the user to perform an operation regarding printing. Although not shown, the operation panel 12 includes a display screen that displays printing information such as, for example, the resolution, the darkness of the ink or the like, the status of the printing device 10 during printing, and the like, and also includes an input button to which the printing information is to be input.

The printing device 10 includes a platen 16. The platen 16 supports the recording medium 5 while printing is performed on the recording medium 5. On the platen 16, the recording medium 5 is allowed to be placed. Printing on the recording medium 5 is performed while the recording medium 5 is on the platen 16. In this example, the platen 16 extends in the main scanning direction Y. In this preferred embodiment, the platen 16 is an example of a "carrying stand".

In this preferred embodiment, as shown in FIG. 3, the platen 16 includes a main platen 17*a*, an upstream platen 17*b*, and a downstream platen 17*c*. On the main platen 17*a*, a portion of the recording medium 5 on which ink is to be injected is placed. The main platen 17*a* is located below the ink head 35 (see FIG. 2). A top surface of the main platen 17*a* is flat. The upstream platen 17*b* is located upstream with respect to the main platen 17*a*. The upstream platen 17*b* is located to the rear of the main platen 17*a*. The upstream platen 17*b* guides the recording medium 5 to the main platen 17*a*. The upstream platen 17*b* has, for example, an arc-shaped vertical cross-section. The upstream platen 17*b* is curved so as to be extended farther downward and spaced farther from the main platen 17*a*. The downstream platen 17*c* is located downstream with respect to the main platen 17*a*. The downstream platen 17*c* is located to the front of the main platen 17*a*. The downstream platen 17*c*, for example, guides the recording medium 5 placed on the platen 16 to a roll-up device 18 (see FIG. 1) that rolls up the recording medium 5. The downstream platen 17*c* has, for example, an arch-shaped vertical cross-section. The downstream platen 17*c* is curved so as to be extended farther downward and spaced farther from the main platen 17*a*.

As shown in FIG. 2, the printing device 10 includes a head moving mechanism 31 and a medium transportation mechanism 32. The head moving mechanism 31 is a mechanism that moves the ink head 35 in the main scanning direction Y with respect to the recording medium 5 placed on the platen 16. In this preferred embodiment, the head moving mechanism 31 moves the ink head 35 in the main scanning direction Y. In this example, the head moving mechanism 31 includes a guide rail 20, a pulley 21, a pulley 22, an endless belt 23, a first driving motor 24, and a carriage 30. The guide rail 20 guides the carriage 30 for the movement in the main scanning direction Y. As shown in FIG. 3, the guide rail 20 is located above the platen 16 (more specifically, the main platen 17*a*). As shown in FIG. 2, the guide rail 20 extends in the main scanning direction Y. The pulley 21 is provided at a left end portion of the guide rail 20. The pulley 22 is provided at a right end portion of the guide rail 20. The belt 23 is wound around, and extends between, the pulley 21 and the pulley 22. In this preferred embodiment, the right pulley 22 is connected with the first driving motor 24. In this case, the right pulley 22 is a driving pulley. The left pulley 21 is a subordinate pulley. Alternatively, the first driving motor 24 may be connected with the left pulley 21. In this preferred embodiment, the first driving motor 24 is driven to rotate the pulley 21, so that the belt 23 runs between the pulley 21 and the pulley 22.

The carriage 30 is attached to the belt 23. As shown in FIG. 3, the carriage 30 is in engagement with the guide rail 20. The carriage 30 is slidable with respect to the guide rail 20. As shown in FIG. 2, the ink head 35 is mounted on the carriage 30. In this preferred embodiment, as the first driving motor 24 is driven to run the belt 23 and thus the carriage 30 moves in the main scanning direction Y, the head moving mechanism 31 moves the ink head 35 mounted on the carriage 30 in the main scanning direction Y.

The medium transportation mechanism 32 moves the recording medium 5 placed on the platen 16 in the sub scanning direction X with respect to the ink head 35. In this example, the medium transportation mechanism 32 moves the recording medium 5 placed on the platen 16 in the sub scanning direction X. There is no specific limitation on the structure of the medium transportation mechanism 32. In this preferred embodiment, the transportation mechanism 32 includes a grit roller 25, a pinch roller 26, and a second driving motor 27 (see FIG. 5). As shown in FIG. 3, the grit roller 25 is provided on the main platen 17*a* of the platen 16. In this example, at least a portion of the grit roller 25 is embedded into the main platen 17*a* of the platen 16. The pinch roller 26 presses the recording medium 5 from above. The pinch roller 26 is located above the main platen 17*a* of the platen 16. The pinch roller 26 is located above the grit roller 25. The pinch roller 26 is located at a position facing the grit roller 25 in the up-down direction Z. The pinch roller 26 is movable in the up-down direction Z. There is no specific limitation on the position and the number of each of the grit roller 25 and the pinch roller 26. In this preferred embodiment, as shown in FIG. 2, the grit roller 25 and the pinch roller 26 are located at each of a left end portion and a right end portion of the platen 16.

Figure 5:
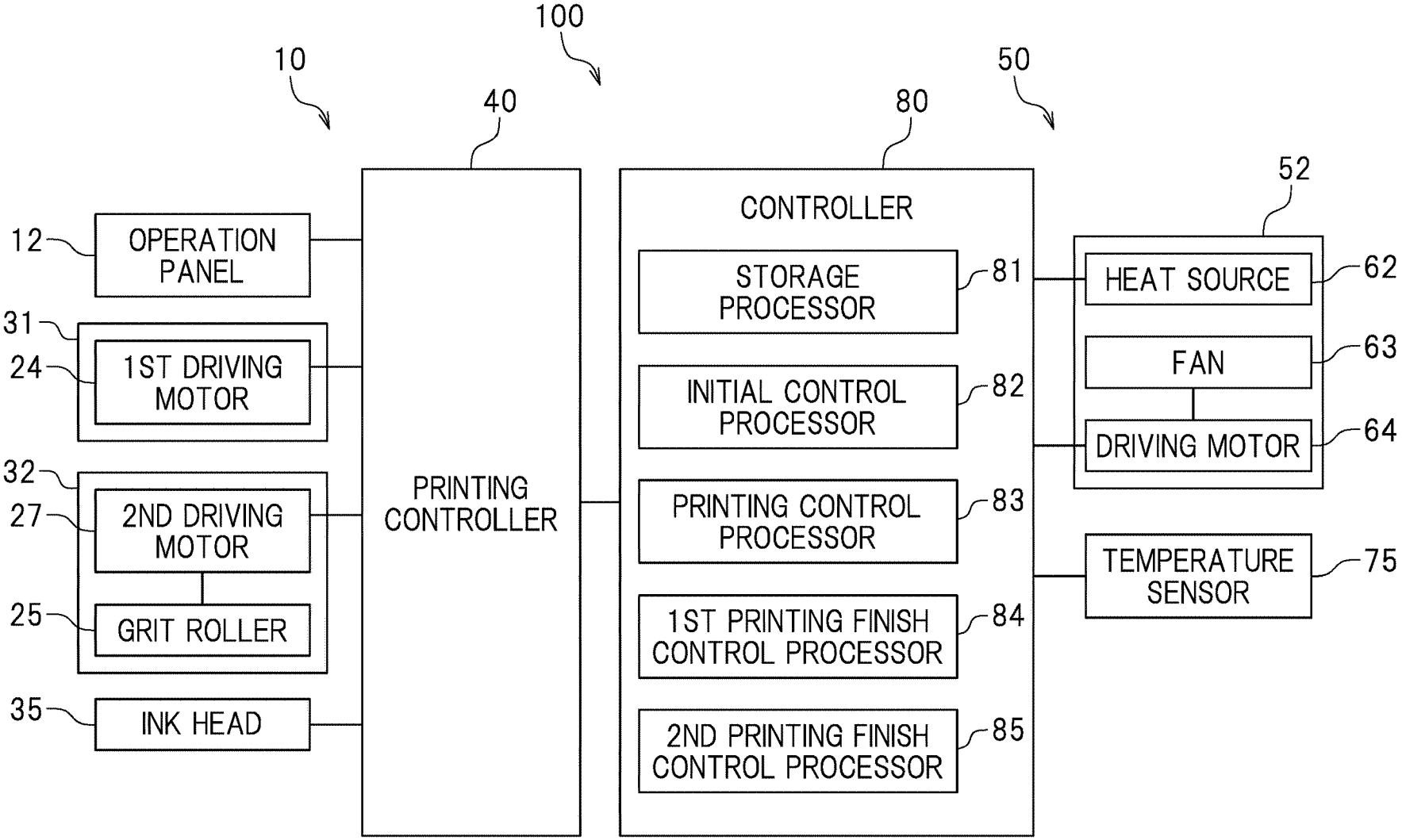
FIG. 5 is a block diagram of the printing system.

In this preferred embodiment, as shown in FIG. 5, the second driving motor 27 is connected with the grit roller 25. When the second driving motor 27 is driven to rotate the grit roller 25 in the state where the recording medium 5 is held between the grit roller 25 and the pinch roller 26, the recording medium 5 is transported in the sub scanning direction X.

Figure 4:
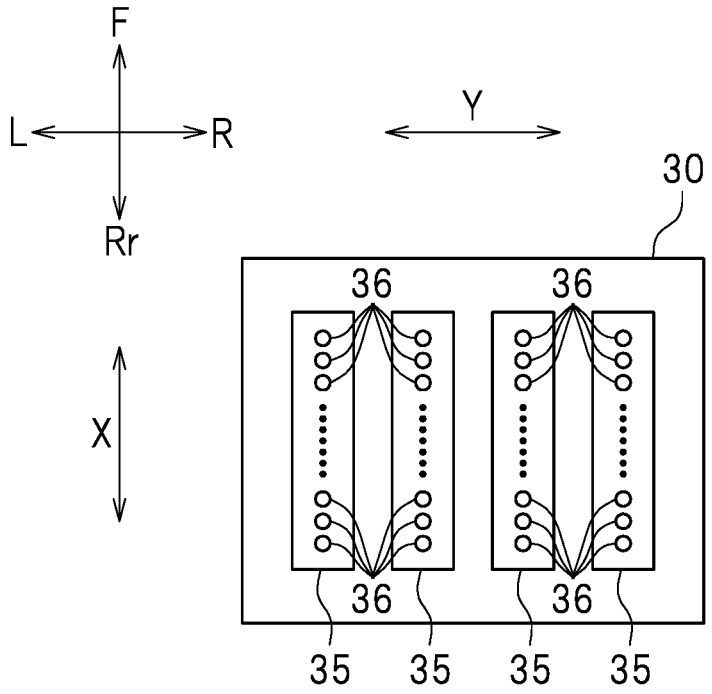
FIG. 4 is a schematic view showing a structure of a surface of a carriage that faces a recording medium.

FIG. 4 is a schematic view showing a structure of a surface of the carriage 30 that faces the recording medium 5 (in this preferred embodiment, bottom surface). As shown in FIG. 4, the printing device 10 includes a plurality of the ink heads 35. The ink heads 35 inject ink. The ink heads 35 are mounted on the carriage 30. The ink heads 35 are held on the bottom surface of the carriage 30. As shown in FIG. 2, the ink heads 35 are located above the platen 16. The ink heads 35 are slidable along the guide rail 20 via the carriage 30. The ink heads 35 are movable by the head moving mechanism 31 (see FIG. 2) in the main scanning direction Y along the guide rail 20. As shown in FIG. 4, a plurality of nozzles 36 arrayed in the sub scanning direction X are provided in the bottom surface of each of the ink heads 35. Ink is injected from the plurality of nozzles 36. In this preferred embodiment, there are four ink heads 35, for example. There is no specific limitation on the number of the ink heads 35. The four ink heads 35 are arrayed side by side in the main scanning direction Y. For example, ink of different color tones is injected from the four ink heads 35.

In this preferred embodiment, the plurality of ink heads 35 are respectively connected with ink cartridges 37 (see FIG. 2) via ink supply paths (not shown). The ink cartridges 37 are detachably located at, for example, a left end portion of the printer main body 10*a*. There is no specific limitation on the material of the ink. Any of various materials conventionally used as a material of ink for a printing device is usable. The ink may be, for example, solvent-based pigment ink or aqueous pigment ink. The ink may be aqueous dye ink, ultraviolet-curable pigment ink cured when being irradiated with ultraviolet light.

FIG. 5 is a block diagram of the printing system 100. As shown in FIG. 5, the printing device 10 includes a printing controller 40. The printing controller 40 is a device that is configured or programmed to control printing on the recording medium 5. There is no specific limitation on the structure of the printing controller 40. The printing controller 40 is, for example, a microcomputer. There is no specific limitation on the hardware structure of the microcomputer. The microcomputer includes, for example, an interface (I/F) that receives printing data or the like from an external device such as a host computer or the like, a central processing unit (CPU) that executes an instruction of a control program, a ROM (read only memory) that has stored thereon a program to be executed by the CPU, a RAM (random access memory) usable as a working area in which the program is developed, and a storage device such as a memory or the like that stores the above-described program and various data. The printing controller 40 preferably is provided in the printer main body 10*a*, for example. In this preferred embodiment, the printing controller 40 is provided, for example, inside the operation panel 12 (see FIG. 2). It should be noted that the printing controller 40 does not need to be provided in the printer main body 10*a*. The printing controller 40 may be, for example, a computer or the like installed outer to the printer main body 10*a*. In this case, the printing controller 40 is communicably connected with the printer main body 10*a* in a wired or wireless manner.

As shown in FIG. 5, in this preferred embodiment, the printing controller 40 is communicably connected with the operation panel 12, the first driving motor 24 of the head moving mechanism 31, the second driving motor 27 of the medium transportation mechanism 32, and the ink head 35. The printing controller 40 is configured or programmed to control the operation panel 12, the first driving motor 24, the second driving motor 27 and the ink head 35. The printing controller 40 controls the driving of the first motor 24 of the head moving mechanism 31 to control the rotation of the pulley 22 and the running of the belt (see FIG. 2). Thus, the printing controller 40 controls the movement of the ink head 35 in the main scanning direction Y. The printing controller 40 controls the driving of the second driving motor 27 of the medium transportation mechanism 32 to control the rotation of the grit roller 25. Thus, the printing controller 40 controls the movement of the recording medium 5 placed on the platen 16 in the sub scanning direction X. The printing controller controls, for example, the timing at which the ink head 35 injects ink.

Figure 6:
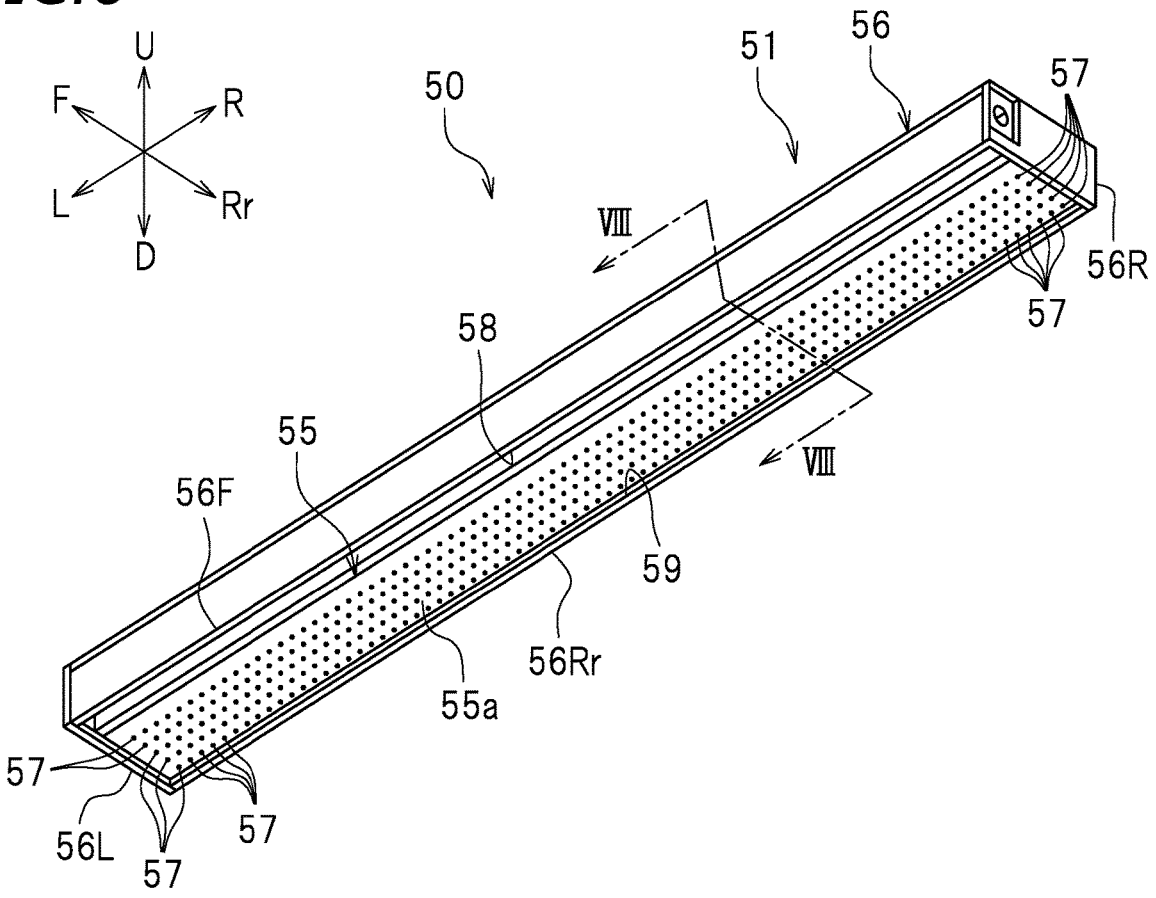
FIG. 6 is a perspective view of an ink drying device.
Figure 7:
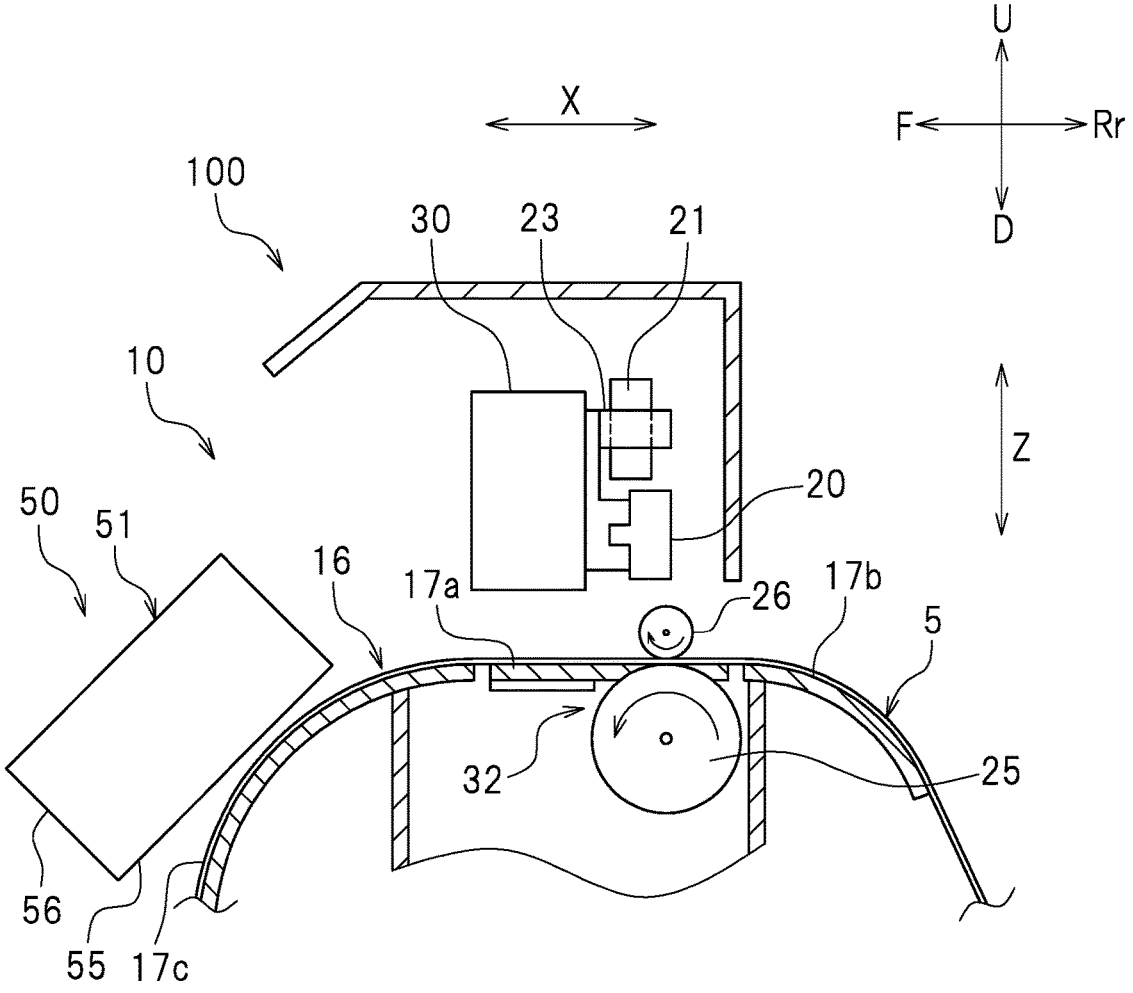
FIG. 7 is a right-side cross-sectional view of the printing device that shows the positional relationship between a platen of the printing device and the ink drying device.
Figure 8:
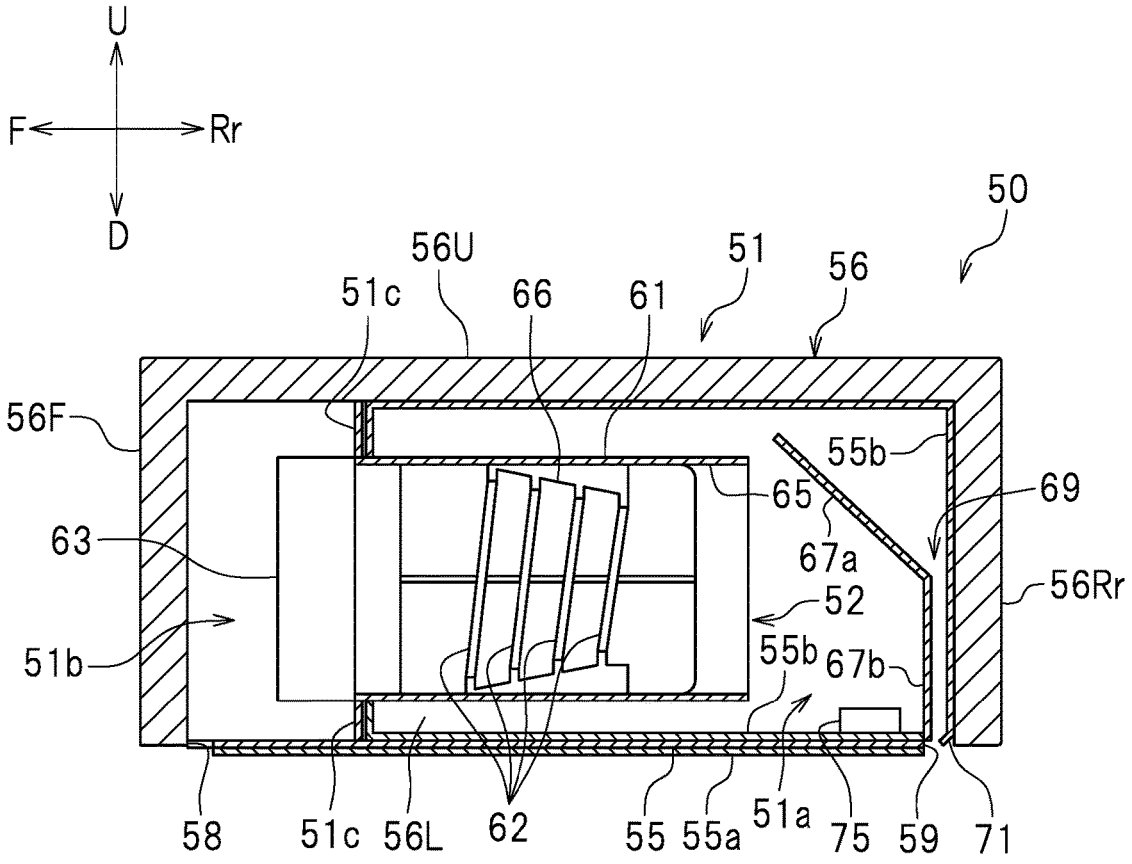
FIG. 8 is a cross-sectional view taken along line VIII-VIII in FIG. 6.

The printing device 10 has been described so far. Now, the ink drying device 50 will be described. FIG. 6 is a perspective view of the ink drying device 50. FIG. 7 is a right-side cross-sectional view of the printing device 10 that shows the positional relationship between the platen 16 of the printing device 10 and the ink drying device 50. FIG. 7 shows a state where the ink drying device 50 is attached to the printing device 10 shown in FIG. 3. FIG. 8 is a cross-sectional view taken along line VIII-VIII in FIG. 6. In the following description of the ink drying device 50, the terms "front", "rear", "left", "right", "up" and "down" respectively represents front, rear, left, right, up and down of the ink drying device 50 as seen in a front view thereof with a main body 51 of the ink drying device 50 being horizontal. In the figures regarding the ink drying device 50, letters F, Rr, L, R, U and D respectively represents front, rear, left, right, up and down in a state where the main body 51 of the ink drying device 50 is horizontal.

The ink drying device 50 is a device that dries ink injected onto the recording medium 5. Specifically, the ink drying device 50 dries ink injected from the ink head 35 onto the recording medium 5 placed on the platen 16 of the printing device 10. In this preferred embodiment, as shown in FIG. 1, the ink drying device 50 is attached to the printing device 10. As shown in FIG. 8, the ink drying device 50 includes the main body 51 and a heat generator 52.

Figure 9:
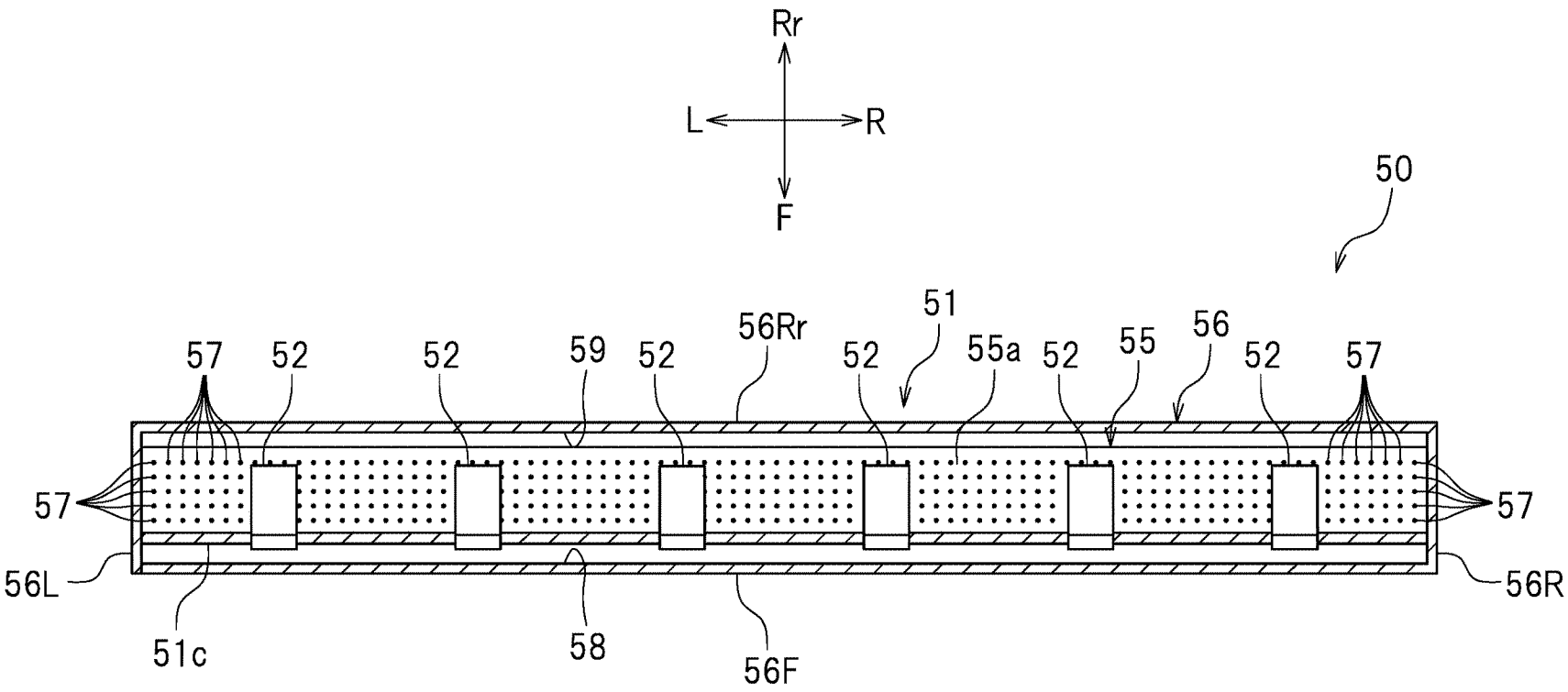
FIG. 9 is a top-side cross-sectional view of a main body of the ink drying device.
Figure 10:
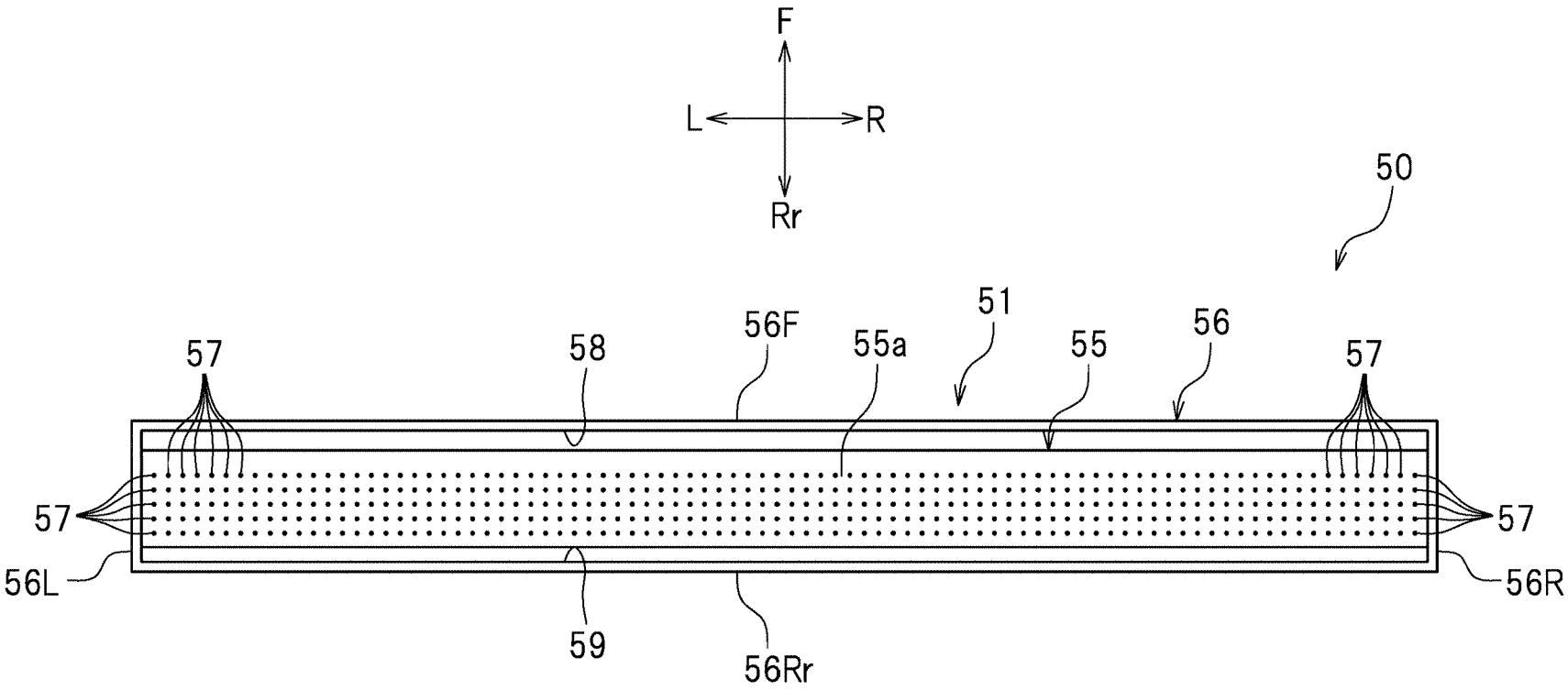
FIG. 10 is a bottom view of the main body of the ink drying device.

FIG. 9 is a top-side cross-sectional view of the main body 51 of the ink drying device 50. FIG. 10 is a bottom view of the main body 51 of the ink drying device 50. As shown in FIG. 9, the main body is a hollow member. The main body 51 is provided with an inner space provided therein. In this preferred embodiment, as shown in FIG. 8, the inner space of the main body 51 is divided into a heat space 51*a* and a communication space 51*b* by a partition 51*c* extending in the up-down direction Z. The heat space 51*a* and the communication space 51*b* are arrayed in the front-rear direction. The heat space 51*a* is located to the rear of the communication space 51*b*. There is no specific limitation on the positional relationship between the heat space 51*a* and the communication space 51*b*. For example, the heat space 51*a* may be located to the front of the communication space 51*b*. In this example, as shown in FIG. 9, the main body 51 extends in the left-right direction (in this example, in the main scanning direction Y). The heat space 51*a* and the communication space 51*b* are each a space extending in the main scanning direction Y. As shown in FIG. 7, the main body 51 is located above the platen 16. More specifically, the main body 51 is located above the downstream platen 17*c* of the platen 16. In this preferred embodiment, as shown in FIG. 8, the main body 51 includes a counter plate 55 and a cover 56.

As shown in FIG. 7, the counter plate 55 faces the recording medium 5 placed on the platen 16 in the state where the ink drying device 50 is attached to the printing device 10. In this preferred embodiment, the counter plate 55 faces the downstream platen 17*c* of the platen 16. The counter plate 55 is inclined forward and downward so as to be extended farther downward and extended farther forward. As shown in FIG. 10, the counter plate 55 preferably is a rectangular or substantially rectangular member extending in the main scanning direction Y, for example. There is no specific limitation on the material of the counter plate 55. In this preferred embodiment, the counter plate 55 is preferably made of a metal material. Specifically, the counter plate 55 is preferably made of, for example, aluminum. In this preferred embodiment, the counter plate 55 is provided with a plurality of discharge holes 57. Air containing heat generated by the heat generator 52 is discharged outside via the discharge holes 57.

As shown in FIG. 8, in this preferred embodiment, a heat diffusion layer 55*a* is provided on an outer surface of the counter plate 55. The outer surface of the counter plate 55 is a bottom surface of the counter plate 55 and faces the platen 16 of the printing device 10. The outer surface of the counter plate 55 is opposite to an inner surface thereof. In this preferred embodiment, the heat diffusion layer 55*a* is a layer that diffuses heat outside. The heat diffusion layer 55*a* diffuses heat efficiently. The heat diffusion layer 55*a* is black. There is no specific limitation on the material of the heat diffusion layer 55*a*. In this preferred embodiment, the heat diffusion layer 55*a* is preferably made of a heat diffusion paint, for example. The outer surface of the counter plate 55 is coated with a heat diffusion paint, so that the heat diffusion layer 55*a* is provided. The heat diffusion paint contains at least a metal oxide. Examples of the metal oxide include, for example, aluminum oxide, silicon dioxide, copper oxide, titanium oxide, manganese dioxide, manganese oxide, iron oxide, cobalt oxide, chromium oxide and the like. The heat diffusion paint is, for example, a far infrared diffusion paint. Alternatively, the heat diffusion paint may contain silica-based inorganic binder, silicone, polyolefin, acrylic resin, urethane, epoxy resin or the like and a heat diffusion ceramic powder dispersed therein. In this example, it is preferred that the heat diffusion paint diffuses far infrared light in a wavelength region in which the heat diffusion ratio for ink is high and the heat diffusion ratio for the recording medium 5 is low. Herein, the "wavelength region in which the heat diffusion ratio for ink is high" is a wavelength region of infrared light that dries ink easily, and is set in accordance with the components of the ink. The "wavelength region in which the heat diffusion ratio for the recording medium 5 is low" is a wavelength region of infrared light that does not destroy, namely, does not damage the recording medium 5, and is set in accordance with the material of the recording medium 5. It is preferred that the heat diffusion paint diffuses far infrared light having, for example, a heat diffusion ratio for the ink to be discharged toward the recording medium 5 of about 60% to about 90% and a heat diffusion ratio for the recording medium 5 of about 40% to about 80%.

As shown in FIG. 8, the cover 56 covers the counter plate 55 from above. In this preferred embodiment, a space enclosed by the counter plate 55 and the cover 56 is the inner space of the main body 51. In other words, the counter plate 55 and the cover 56 form the heat space 51*a* and the communication space 51*b*.

In this preferred embodiment, the cover 56 includes an upper plate 56U, a front plate 56F, a rear plate 56Rr, a left plate 56L, and a right plate 56R (see FIG. 9). The upper plate 56U is located above the counter plate 55 and is rectangular or substantially rectangular, for example. The front plate 56F extends downward from a front end of the upper plate 56U. As shown in FIG. 10, a bottom end of the front plate 56F is located to the front of the counter plate 55. As shown in FIG. 8, the rear plate 56Rr extends downward from a rear end of the upper plate 56U. The rear plate 56Rr faces the front plate 56F. As shown in FIG. 10, a bottom end of the rear plate 56Rr is located to the rear of the counter plate 55. As shown in FIG. 6, the left plate 56L extends downward from a left end of the upper plate 56U. The left plate 56L is connected with the front plate 56U and the rear plate 56Rr. As shown in FIG. 10, the left plate 56L is connected with a left end of the counter plate 55. As shown in FIG. 6, the right plate 56R extends downward from a right end of the upper plate 56U. The right plate 56R is connected with the front plate 56F and the rear plate 56Rr. As shown in FIG. 10, the right plate 56R is connected with a right end of the counter plate 55. There is no specific limitation on the material of the cover 56. In this preferred embodiment, the cover 56 is preferably made of a metal material and a resin. For example, the left plate 56L and the right plate 56R of the cover 56 are preferably made of a resin. The upper plate 56U, the front plate 56F and the rear plate 56Rr are preferably made of aluminum. It should be noted that the upper plate 56U, the front plate 56F and the rear plate 56Rr may each have a two-layer structure. In this case, the upper plate 56U, the front plate 56F and the rear plate 56Rr each include an inner layer in contact the space inner to the cover 56 and an outer layer in contact with the outside of the cover 56. The inner layer of each of the upper plate 56U, the front plate 56F and the rear plate 56Rr is preferably made of a resin. The outer layer of each of the upper plate 56U, the front plate 56F and the rear plate 56Rr is preferably made of a metal material. The resin that forms the cover 56 is, for example, a fluorine resin (e.g., tetrafluoroethylene perfluoroalkylvinylether copolymer (PFA)). Alternatively, the resin that forms the cover 56 may be polyphenylenesulfide (PPS) resin. The cover 56 may be made of only a metal material. The cover 56 may be made of only a resin.

In this preferred embodiment, the left plate 56L of the cover 56 of the main body 51 is connected with the platen 16 via a left connecting member (not shown). The right plate 56R of the cover 56 is connected with the platen 16 via a right connecting member (not shown). With such an arrangement, the ink drying device 50 is attached to the printing device 10.

In this preferred embodiment, as shown in FIG. 8, a heat diffusion layer 55*b* is provided on an inner circumferential surface of the main body 51, namely, the inner surface of the counter plate (in other words, the top surface of the counter plate 55) and an inner circumferential surface of the cover 56. FIG. 9 omits the heat diffusion layer 55*b*. The heat diffusion layer 55*b* is of the same material as that of the heat diffusion layer 55*a* provided on the outer surface of the counter plate 55. It should be noted that the heat diffusion layer 55*b* may be provided on a portion of the inner circumferential surface of the main body 51. For example, the heat diffusion layer 55*b* may be provided on the inner surface of the counter plate 55 and on the upper plate 56U of the cover 56. Alternatively, the heat diffusion layer 55*b* may be provided on a portion of the inner surface of the counter plate 55 and on a portion of the inner circumferential surface of the cover 56.

In this preferred embodiment, as shown in FIG. 10, an absorption slit 58 and a discharge slit 59 are located between the counter plate 55 and the cover 56 as seen in a bottom view. The absorption slit 58 is a gap located between a front end of the counter plate 55 and the bottom end of the front plate 56F of the cover 56. The absorption slit 58 extends in the main scanning direction Y. The communication space 51*b* (see FIG. 8) of the main body 51 and the outside of the main body 51 are in communication with each other via the absorption slit 58. The discharge slit 59 is a gap located between a rear end of the counter plate 55 and the bottom end of the rear plate 56Rr of the cover 56. The discharge slit 59 extends in the main scanning direction Y. The discharge slit 59 is located to the rear of the absorption slit 58. The heat space 51*a* (see FIG. 8) of the main body 51 and the outside of the main body 51 are in communication with each other via the discharge slit 59.

In this preferred embodiment, as shown in FIG. 1, the length of the main body 51 in the main scanning direction Y, namely, the length of the counter plate 55 and the length of the cover 56 of the main body 51 in the main scanning direction Y, is the same as the length of the platen 16 in the main scanning direction Y. Alternatively, the length of the counter plate 55 and the length of the cover 56 of the main body 51 in the main scanning direction Y may be longer than, or shorter than, the length of the platen 16 in the main scanning direction Y.

As shown in FIG. 8, the heat generator 52 is a mechanism that generates heat. In this preferred embodiment, as shown in FIG. 9, a plurality of the heat generators 52 are provided in the inner space of the main body 51. There is no specific limitation on the number of the heat generators 52. The number of the heat generators 52 is set in accordance with the length of the main body 51 in the left-right direction (in this example, the main scanning direction Y). In this example, there are preferably six heat generators 52. The plurality of heat generators 52 are arrayed in the main scanning direction Y. The heat generators 52 adjacent to each other are located at a predetermined interval. In this preferred embodiment, the heat generators 52 preferably have the same structure, for example. Thus, a structure of one heat generator 52 will be described.

In this preferred embodiment, as shown in FIG. 8, the heat generator 52 includes a heat source case 61, a heat source 62, a fan 63, and a driving motor 64 (FIG. 5). The heat source case 61 is located in the main body 51. The heat source case 61 is provided with an inner space therein. The heat source case 61 is provided with a heat source-side discharge hole 65. The heat source-side discharge hole 65 is a hole through which heat generate by the heat source 62 is discharged. The inner space of the heat source case 61 and the heat space 51*a* of the main body 51 are in communication with each other via the heat source-side discharge hole 65.

The heat source 62 is located in the inner space of the heat source case 61. The heat source 62 generates heat. There is no specific limitation on the structure of the heat source 62. For example, the heat source 62 is a nichrome wire heater. In this preferred embodiment, a winding core 66 is located in the heat source case 61. The nichrome wire heater as the heat source 62 is wound around the winding core 66.

The fan 63 is provided to take air outside the main body 51 to the inside of the heat source case 61. The fan 63 is provided on the heat source case 61. In this example, the fan 63 is provided on the heat source case 61 so as to be exposed to the communication space 51*b* of the main body 51. The fan 63 faces the heat source-side discharge hole 65. The heat source 62 is located between the fan 63 and the heat source-side discharge hole 65. The driving motor 64 is a motor that rotates the fan 63. As shown in FIG. 5, the driving motor 64 is connected with the fan 63. In this example, the driving motor 64 is driven to rotate the fan 63. At this point, the air outside the main body 51 is absorbed into the communication space 51*b* of the main body 51 via the absorption slit 58, which is the gap between the counter plate 55 and the cover 56 of the main body 51. The air absorbed into the communication space 51*b* is taken into the inner space of the heat source case 61 via the fan 63. Then, the air taken into the inner space of the heat source case 61 is provided with heat generated by the heat source 62. The air provided with the heat is discharged to the heat space 51*a* of the main body 51 via the heat source-side discharge hole 65. A portion of the heat discharged to the heat space 51*a* is discharged, together with the air, via the discharge holes 57 (see FIG. 10) in the counter plate 55 toward the ink injected onto the recording medium 5 placed on the platen 16 (more specifically, the downstream platen 17*c* (see FIG. 7)). Another portion of the heat discharged to the heat space 51*a* is discharged, together with the air, via the discharge slit 59 between the counter plate 55 and the cover 56 of the main body 51.

In this preferred embodiment, a first guide 67*a* and a second guide 67*b* are provided in the heat space 51*a* of the main body 51. The first guide 67*a* and the second guide 67*b* preferably are plate-shaped members extending in the main scanning direction Y. The second guide 67*b* extends upward from the right end of the counter plate 55. A bottom end of the second guide 67*b* is continuous from the right end of the counter plate 55. The first guide 67*a* is continuous from a top end of the second guide 67*b*. The first guide 67*a* extends obliquely so as to be closer to the center, in the front-rear direction, of the heat space 51*a* and to be spaced farther from the second guide 67*b*. The first guide 67*a* is spaced farther from the rear plate 56Rr of the cover 56 and closer to the upper plate 56U. In this example, the first guide 67*a*, the second guide 67*b* and the rear plate 56Rr of the cover 56 define a path 69. A portion of the heat discharged to the heat space 51*a* passes the path 69. The path 69 is in communication with the discharge slit 59.

In this preferred embodiment, a third guide 71 is provided in discharge slit 59. The third guide 71 preferably is a plate-shaped member extending in the main scanning direction Y. The third guide 71 extends obliquely, forward and downward, from the bottom end of the rear plate 56Rr of the cover 56. In this preferred embodiment, the third guide 71 is an example of a "guide". In this example, a portion of the heat discharged to the heat space 51*a* passes the path 69 and is discharged via the discharge slit 59, together with the air. At this point, the heat and the air are discharged forward and downward while being guided by the third guide 71.

In this preferred embodiment, the ink drying device 50 includes a temperature sensor 75. The temperature sensor 75 is provided in the main body 51. In this example, the temperature sensor 75 is provided on the counter plate 55 of the main body 51. The temperature sensor 75 detects the temperature of the air to be discharged via the discharge holes 57 (see FIG. 10) of the counter plate 55. There is no specific limitation on the position or the type of the temperature sensor 75. For example, the temperature sensor 75 may be provided on the cover 56 of the main body 51. The temperature sensor 75 is, for example, a thermistor.

As shown in FIG. 5, the ink drying device 50 includes a controller 80. The controller 80 controls the drying of the ink injected onto the recording medium 5. There is no specific limitation on the structure of the controller 80. The controller is, for example, a microcomputer. There is no specific limitation on the hardware structure of the microcomputer. The microcomputer includes, for example, an interface (I/F) that receives printing data or the like from an external device such as a host computer or the like, a CPU, a ROM, a RAM, a storage device and the like. The controller 80 is preferably provided in the main body 51, for example. Alternatively, the controller 80 may be a computer or the like installed outside the main body 51. In this case, the controller 80 is communicably connected with the main body 51 in a wired or wireless manner.

In this preferred embodiment, the controller 80 is communicably connected with the heat source 62, the driving motor 64 connected with the fan 63, and the temperature sensor 75. The controller 80 is configured or programmed to control the heat source 62, the driving motor 64 and the temperature sensor 75. The controller 80 controls the heat source 62 to control the amount and intensity of the heat generated by the heat source 62. The controller 80 controls the driving motor 64 to control the rotation of the fan 63. Thus, the controller 80 controls the amount of the air to be absorbed into the inner space of the heat source case 61 from outside the main body 51 and the amount of the heat and the air to be discharged via the discharge slit 59 (see FIG. 8). The controller 80 receives information on the temperature of the air, to be discharged via the discharge holes 57 of the counter plate 55, detected by the temperature sensor 75. In this preferred embodiment, the controller 80 is communicably connected with the printing controller 40 of the printing device 10. The controller controls the heat source 62 and the driving motor 64 in accordance with the control performed by the printing controller 40.

In this preferred embodiment, the controller 80 is configured or programmed to include a storage processor 81, an initial control processor 82, a printing control processor 83, a first printing finish control processor 84, and a second printing finish control processor 85. In this example, the components of the controller 80 shown in FIG. 5 are defined by a single processor, or two or more processors. Alternatively, the functions of these components of the controller 80 may be provided by software or hardware. The functions of these components of the controller 80 may also be incorporated into circuits.

Figure 11:
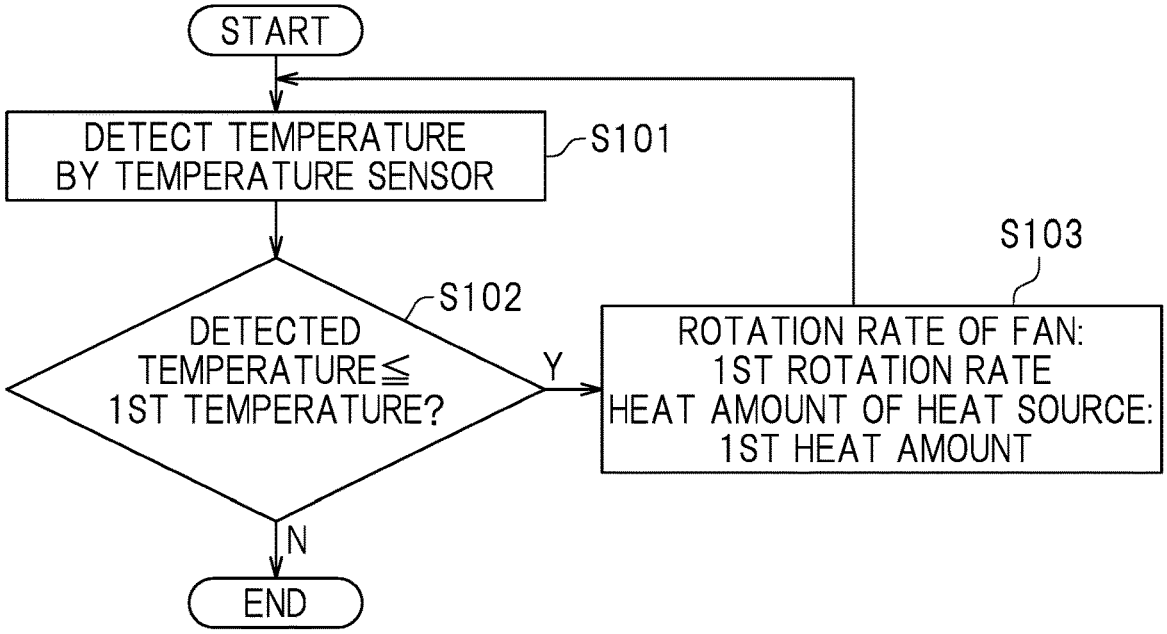
FIG. 11 is a flowchart showing a procedure of control of the ink drying device performed before printing is started.

The initial control processor 82 is configured or programmed to control the ink drying device 50 before the printing device 10 starts printing. For example, the initial control processor 82 starts operating when a main power (not shown) of the ink drying device 50 is turned on. In this preferred embodiment, the procedure of control by the initial control processor 82 is performed in accordance with the flowchart shown in FIG. 11. Referring to FIG. 11, first in step S101, the initial control processor 82 receives a detected temperature detected by the temperature sensor 75. In this example, the initial control processor 82 transmits a temperature detection signal to the temperature sensor 75. Upon receipt of the temperature detection signal, the temperature sensor 75 detects the detected temperature, which is the temperature of the air to be discharged via the discharge holes 57 of the counter plate 55. The temperature sensor 75 transmits information on the detected temperature to the initial control processor 82. After the initial control processor 82 receives the information on the detected temperature, the procedure advances to step S102 in FIG. 11. In step S102, the initial control processor 82 determines whether or not the detected temperature is no higher than a predetermined first temperature. The "first temperature" is a temperature at which the ink injected onto the recording medium 5 is easily dried, and is appropriately set in advance in accordance with the components of the ink and the material of the recording medium 5. For example, the first temperature is about 45 degrees to about 60 degrees. The first temperature is stored in advance on the storage processor 81.

In the case where the detected temperature is lower than, or equal to, the first temperature, the procedure advances to step S103. In step S103, the amount of the air to be absorbed via the fan 63 is decreased, and the amount of the heat to be generated by the heat source 62 is increased so as to raise the temperature of the air to be discharged via the discharge holes 57 of the counter plate 55. For this purpose, the initial control processor 82 controls the driving motor 64 such that the rotation rate of the fan 63 is a predetermined first rotation rate, and controls the heat source 62 such that the amount of the heat to be generated by the heat source 62 is a predetermined first heat amount. Then, after an elapse of a predetermined time period, the process in step S101 is performed again. The first rotation rate and the first heat amount are appropriately set in accordance with the first temperature and the type of the printing device 10. The first rotation rate and the first heat amount are stored in advance on the storage processor 81. In the case where the detected temperature is higher than the first temperature in step S102, the temperature of the air to be discharged via the discharge holes 57 of the counter plate 55 is sufficiently high. In this case, the initial control is finished.

The printing control processor 83 controls the ink drying device 50 at the time of printing after the control by the initial control processor 82 is finished. The expression "at the time of printing" refers to when printing by the printing device 10 is started, namely, injection of the ink from the ink head 35 toward the recording medium 5 is started. In this preferred embodiment, the printing control processor 83 receives a printing start signal from the printing controller 40. Then, the printing control processor 83 controls the driving motor 64 such that the rotation rate of the fan 63 is a predetermined second rotation rate. The second rotation rate is greater than the first rotation rate. The second rotation rate is the maximum rotation rate preset for the fan 63. The second rotation rate is stored in advance on the storage processor 81. In the case where the rotation rate of the fan 63 is the second rotation rate, the flow rate of the air flowing via the discharge slit 59 (see FIG. 8) is increased. There is no specific limitation on the amount of the heat to be generated by the heat source 62 at the time of printing. For example, the printing control processor 83 may control the heat source 62 such that the amount of the heat to be generated by the heat source 62 is the first heat amount. Alternatively, the printing control processor 83 may control the heat source 62 such that the amount of the heat to be generated by the heat source 62 is a second heat amount. The second heat amount is smaller than the first heat amount. For example, the second heat amount is such an amount that maintains the temperature of the air to be discharged via the discharge holes 57 of the counter plate 55 at the first temperature. In this case, the second heat amount is stored in advance on the storage processor 81.

Figure 12:
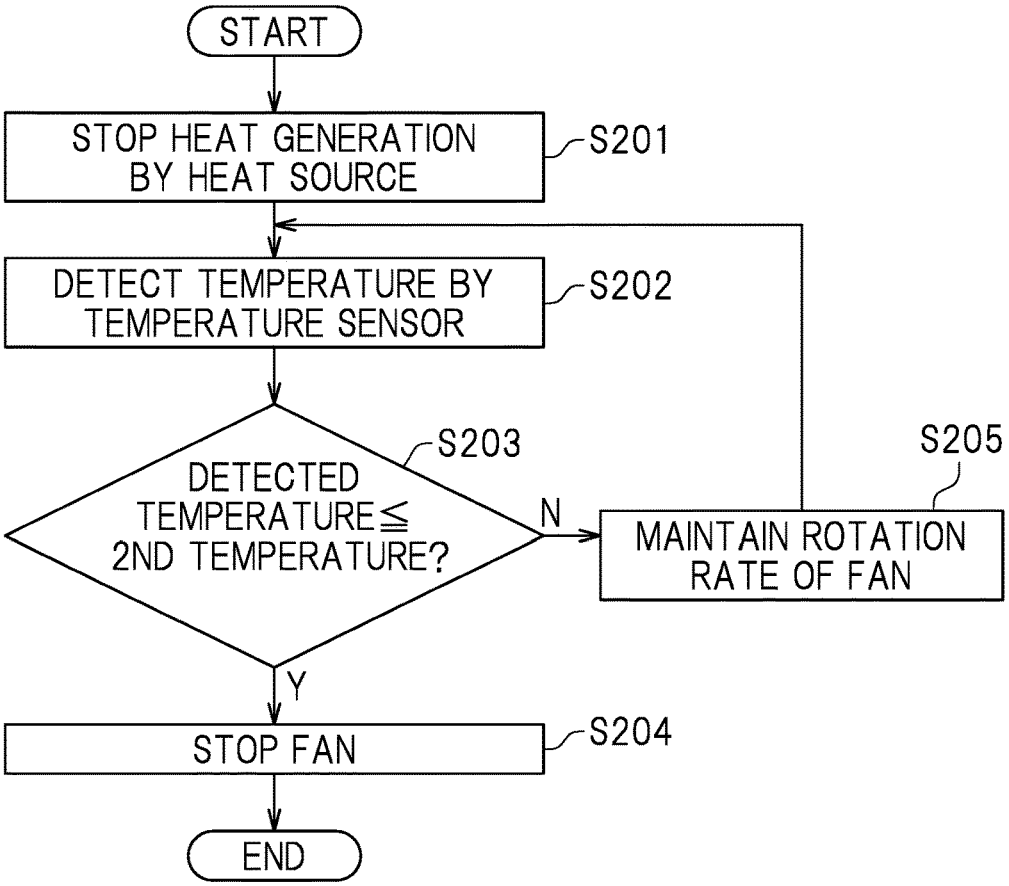
FIG. 12 is a flowchart showing a procedure of control of the ink drying device performed after printing is finished.

The first printing finish control processor 84 and the second printing finish control processor 85 control the ink drying device 50 at the time of finish of printing. The expression "at the time of finish of printing" refers to when the printing by the printing device 10 is finished, namely, when the injection of the ink from the ink head 35 is finished. In this preferred embodiment, the procedure of control at the time of finish of printing is performed in accordance with the flowchart shown in FIG. 12. Referring to FIG. 12, first in step S201, at the time of finish of printing, the first printing finish control processor 84 controls the heat source 62 such that the heat generation by the heat source 62 is stopped. After the heat generation by the heat source 62 is stopped, the second printing finish control processor 85, in step S202 in FIG. 12, receives the detected temperature from the temperature sensor 75. In this example, the second printing finish control processor 85 transmits a temperature detection signal to the temperature sensor 75. Upon receipt of the temperature detection signal, the temperature sensor 75 detects the detected temperature, which is the temperature of the air to be discharged via the discharge holes 57 of the counter plate 55. The temperature sensor 75 transmits information on the detected temperature to the second printing finish control processor 85. After receiving the information on the detected temperature, the second printing finish control processor 85, in step S203 shown in FIG. 12, determines whether or not the detected temperature is no higher than a predetermined second temperature. The "second temperature" is lower than the first temperature. The second temperature is a so-called idling temperature and is appropriately set by the ink drying device 50. The second temperature is stored in advance on the storage processor 81.

In the case where the detected temperature received by the second printing finish control processor 85 is lower than, or equal to, the second temperature, the procedure advances to step S204 in FIG. 12. In step S204, the second printing finish control processor 85 controls the driving motor 64 such that the fan 63 is stopped. Thus, the procedure in the flowchart in FIG. 12 is finished. By contrast, in the case where the detected temperature received by the second printing finish control processor 85 is higher than the second temperature in step S203, the procedure advances to step S205 in FIG. 12. In step S205, the second printing finish control processor 85 maintains the rotation rate of the fan 63. Then, the process in step S202 is performed again. As can be seen, at the time of finish of printing, the second printing finish control processor 85 controls the driving motor 64 such that the driving motor 64 keeps on rotating the fan 63 until the temperature of the air to be discharged via the discharge holes 57 of the counter plate 55 becomes the second temperature, which is the idling temperature.

As described above, in this preferred embodiment, as shown in FIG. 8, the heat generated by the heat generator 52 is discharged, together with the air, to the outside of the main body (more specifically, below the main body 51) via the discharge holes 57 (see FIG. 10) in the counter plate 55. The discharged heat is diffused by the heat diffusion layer 55*a* on the outer surface of the counter plate 55 and reaches the ink injected onto the recording medium 5. As a result, the ink injected onto the recording medium 5 is directly dried by the heat diffused by the heat diffusion layer 55*a*. Therefore, even in the case where the recording medium 5 is relatively thick, the ink injected onto the recording medium 5 is efficiently dried by the heat diffused by the heat diffusion layer 55*a*. This prevents the drying of the ink from becoming difficult due to, for example, the thickness of the recording medium 5.

In this preferred embodiment, the heat diffusion layer 55*a* is preferably made of a heat diffusion paint, for example. The heat diffusion paint contains at least a metal material. With such an arrangement, the heat diffusion layer 55*a* is formed on the outer surface of the counter plate 55 by a simple method of coating the outer surface of the counter plate 55 with a heat diffusion paint.

In this preferred embodiment, the heat diffusion paint diffuses light in a wavelength region having a high heat diffusion ratio for ink and a low heat diffusion ratio for the recording medium 5. With such an arrangement, the recording medium 5 is not easily damaged, and the ink injected onto the recording medium 5 is dried efficiently.

In this preferred embodiment, the heat diffusion layer 55*b* is provided on the inner surface of the counter plate 55. In this example, the heat diffusion layer 55*b* is provided on the inner circumferential surface of the cover 56. The heat diffusion layer 55*b* is preferably made of the same material as that of the heat diffusion layer 55*a*. With such an arrangement, the heat is diffused by the heat diffusion layer 55*b* in the heat space 51*a* of the main body 51. Since this increases the amount of the diffused heat discharged via the discharge holes 57 of the counter plate 55, the heat reaching the ink injected onto the recording medium 5 is not easily attenuated. Therefore, the ink injected onto the recording medium 5 is dried more efficiently.

In this preferred embodiment, the heat generator 52 includes the heat source case 61, the heat source 62 located in the inner space of the heat source case 61, and the fan 63 provided on the heat source case 61. The heat source case 61 is provided with the heat source-side discharge hole 65, via which the heat generated by the heat source 62 is discharged to the heat space 51*a* of the main body 51. With such an arrangement, the amount of the heat generated by the heat source 62 and discharged to the heat space 51*a* of the main body 51 through the heat source-side discharge hole 65 by the fan 63 is increased. Since the amount of the heat discharged via the discharge holes 57 of the counter plate 55 is increased, the ink injected onto the recording medium 5 is dried more efficiently.

In this preferred embodiment, as shown in FIG. 10, the discharge slit 59 is located between the rear end of the counter plate 55 and the bottom end of the rear plate 56Rr of the cover 56. The discharge slit 59 extends in the main scanning direction Y and is larger than each of the discharge holes 57. The path 69, which is in communication with the discharge slit 59 and allows passage of a portion of the heat generated by the heat source 62, is located in the heat space 51*a* of the main body 51. With such an arrangement, a portion of the heat generated by the heat source 62 is discharged downward from the main body 51 via the path 69 and the discharge slit 59. The heat discharged via the discharge slit 59 is on a downward convection caused by the temperature difference between the inside and the outside of the heat space 51*a* and reaches the ink injected onto the recording medium 5. The heat on the convection easily reaches the recording medium 5. This forces the heat generated by the heat source 62 to reach the ink. Therefore, the ink injected onto the recording medium 5 is dried efficiently. In this preferred embodiment, another portion of the heat generated by the heat source 62 is discharged below the main body 51 via the discharge holes 57 (see FIG. 10) in the counter plate 55. The heat discharged via the discharge holes 57 is diffused by the heat diffusion layer 55*a* and reaches the ink injected onto the recording medium 5. As can be seen, in this preferred embodiment, the heat diffused by the heat diffusion layer 55*a*, and the heat discharged via the discharge slit 59 and forcibly put on the convection to reach the ink injected onto the recording medium 5, are used together to dry the ink injected onto the recording medium 5. Therefore, the ink injected onto the recording medium 5 is dried more efficiently.

In this preferred embodiment, as shown in FIG. 8, the third guide 71 extending obliquely, downward and forward, is provided in the discharge slit 59. With such an arrangement, the heat and the air discharged via the discharge slit 59 are put on the convection generated obliquely, downward and forward, while being guided by the third guide 71, and thus are discharged. This makes it difficult for water vapor, generated when the ink is dried, to reach the heat diffusion layer 55*a*. Therefore, the heat diffusion layer 55*a* is prevented from being stained, and the diffusion of the heat by the heat diffusion layer 55*a* is prevented from being weakened by the heat diffusion layer 55*a* being stained.

In this preferred embodiment, the initial control processor 82 determines whether or not the detected temperature detected by the temperature sensor 75 is no higher than the predetermined first temperature, before printing is started. In the case where the detected temperature is lower than, or equal to, the first temperature, the initial control processor 82 controls the driving motor 64 such that the rotation rate of the fan 63 is the predetermined first rotation rate, and controls the heat source 62 such that the amount of the heat to be generated by the heat source 62 is the first heat amount. As a result, before printing is started, the amount of the heat generated by the heat source 62 is increased. This efficiently raises the temperature of the air to be discharged via the discharge holes 57 of the counter plate 55. Therefore, even immediately after printing is started, the ink injected onto the recording medium 5 is dried efficiently.

In this preferred embodiment, the printing control processor 83 controls the driving motor 64 such that the rotation rate of the fan 63 is the second rotation rate, which is greater than the first rotation rate, at the time of printing. The second rotation rate is, for example, the maximum rotation rate of the fan 63. This increases the flow rate of the air to be discharged via the discharge slit 59 during printing. Therefore, the ink injected onto the recording medium 5 is dried efficiently.

In this preferred embodiment, the first printing finish control processor 84 stops the heat generation by the heat source 62. After the heat generation by the heat source 62 is stopped by the first printing finish control processor 84, the second printing finish control processor 85 determines whether or not the detected temperature detected by the temperature sensor 75 is no higher than the second temperature, which is lower than the first temperature. In the case where the detected temperature is lower than, or equal to, the second temperature, the second printing finish control processor 85 stops the driving motor 64. At the time of finish of printing, ink does not need to be dried. Therefore, the second printing finish control processor 85 stops the heat source 62 and rotates the fan 63. Therefore, the temperature of the air to be discharged via the discharge holes 57 of the counter plate 55 is lowered efficiently.

In this preferred embodiment, as shown in FIG. 1, the platen 16 of the printing device 10 and the main body 51 of the ink drying device 50 both extend in the main scanning direction Y. With such an arrangement, even in the case where the recording medium 5 is longer in the main scanning direction Y, the ink injected onto the recording medium 5 is dried efficiently by the ink drying device 50.

In this preferred embodiment, as shown in FIG. 7, the ink drying device 50 is attached to the printing device 10 such that the counter plate 55 faces the platen 16 and is above the platen 16. With such an arrangement, even when the printing device 10 is moved, the ink drying device 50 moves along with the printing device 10. Therefore, it is easy to move the ink drying device 50 together with the printing device 10. Even when the printing device 10 is moved, the position of the ink drying device 50 with respect to the printing device 10 is not changed. Therefore, even when the printing device 10 is moved, the position of the ink drying device 50 does not need to be considered.

In the present preferred embodiment, the medium transportation mechanism 32 preferably transports the recording medium 5 placed on the platen 16 downstream in the sub scanning direction X. The main body 51 of the ink drying device 50 is located above the downstream portion of the platen 16 (in this example, above the downstream platen 17*c*). With such an arrangement, after the ink is injected toward the recording medium 5 while the recording medium 5 is placed on the main platen 17*a*, the recording medium 5 having the ink thereon is transported to the downstream platen 17*c*. Therefore, the ink injected onto the recording medium 5 is dried by the ink drying device 50 while the recording medium 5 is placed on the downstream platen 17*c*.

Some preferred embodiments according to the present invention have been described so far. The above-described preferred embodiments are merely examples, and the present invention may be carried out in any of many preferred embodiments. Now, another preferred embodiment will be described briefly. In the following description, components and portions substantially the same as those described above will bear the same reference signs thereto and descriptions thereof may be omitted optionally.

Preferred Embodiment 2

Figure 13:
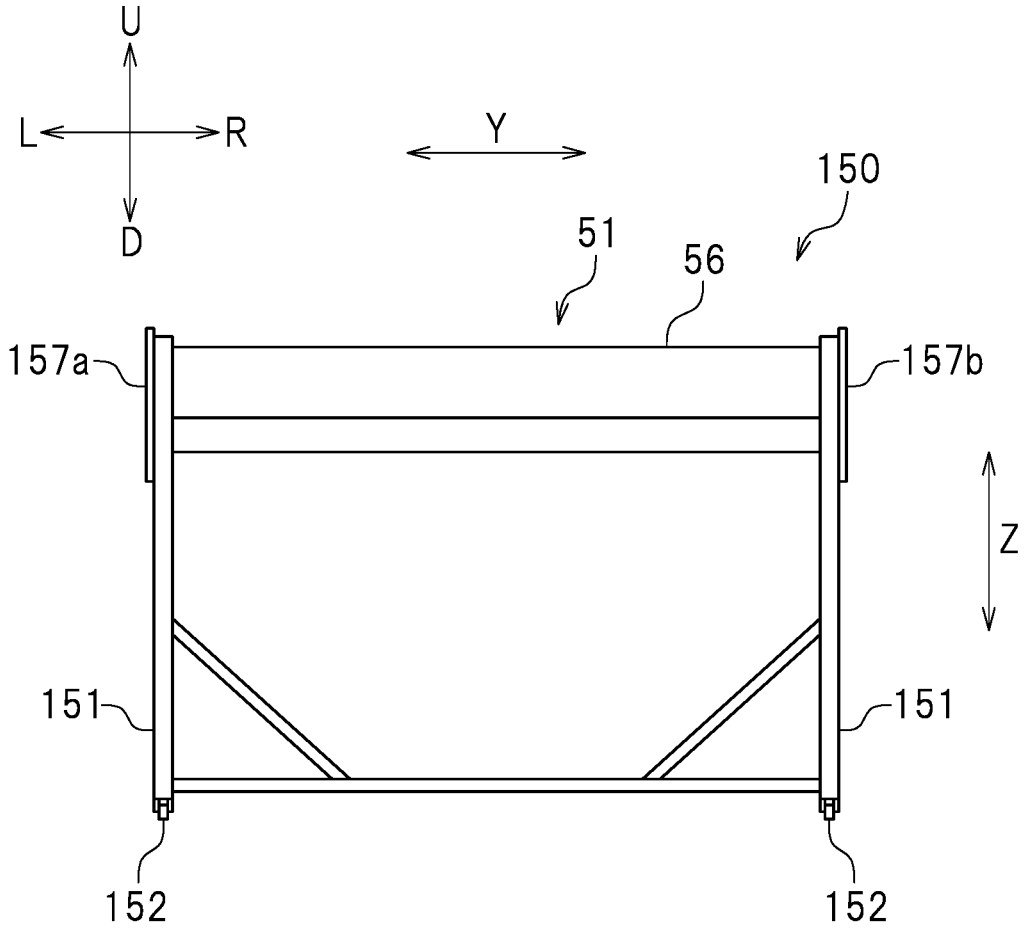
FIG. 13 is a front view of an ink drying device according to preferred embodiment 2 of the present invention.
Figure 14:
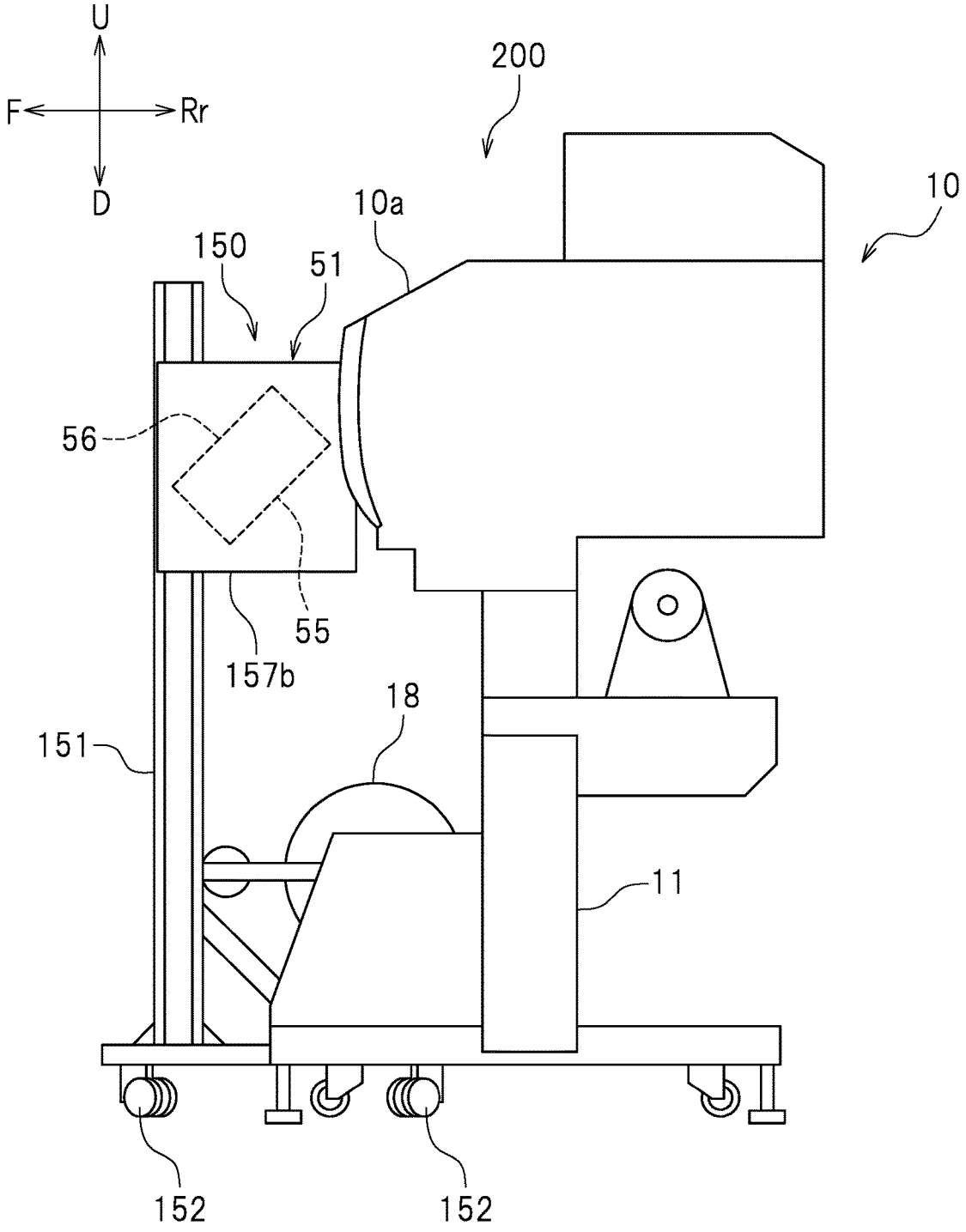
FIG. 14 is a right side view of a printing system according to preferred embodiment 2 of the present invention.

Now, an ink drying device 150 according to preferred embodiment 2 will be described. FIG. 13 is a front view of the ink drying device 150 according to preferred embodiment 2. FIG. 14 is a right side view of a printing system 200 according to preferred embodiment 2. In preferred embodiment 1, the ink drying device 50 preferably is attached to the printing device 10 as shown in FIG. 1. An ink drying device according to the present invention does not need to be attached to the printing device 10. In preferred embodiment 2, for example, as shown in FIG. 13, the ink drying device 150 preferably is independent from the printing device 10. The ink drying device 150 includes the main body 51 that is the same or substantially the same as that in preferred embodiment 1.

In this example, the ink drying device 150 includes legs 151. The legs 151 are attached to the main body 51. In this preferred embodiment, two legs 151 are respectively attached to a left end and a right end of the main body 51, for example. In this example, the main body 51 includes support members 157*a* and 157*b*. The support member 157*a* supports the left plate 56L (see FIG. 10) of the cover 56. The support member 157*b* supports the right plate 56R (see FIG. 10) of the cover 56. The two legs 151 are respectively connected with the support members 157*a* and 157*b*. A caster 152 may be provided at a bottom end of each of the two legs 151.

In this preferred embodiment, the ink drying device 150 may include an angle adjusting mechanism that adjusts the angle of the counter plate 55 with respect to the support members 157*a* and 157*b*. In this example, the left plate 56L of the cover 56 is supported so as to be rotatable around the support member 157*a*. The right plate 56R of the cover 56 is supported so as to be rotatable around the support member 157*b*. Therefore, the angle of the left plate 56L with respect to the support member 157*a* and the angle of the right plate 56R with respect to the support member 157*b* are adjusted, and thus the angle of the counter plate 55 is adjusted.

In this preferred embodiment, as shown in FIG. 14, the ink drying device 150 is located to the front of the printing device 10 such that the main body 51 is located above the downstream platen 17*c* of the platen 16. With such an arrangement, the ink injected onto the recording medium 5 placed on the platen 16 is dried like in preferred embodiment 1.

In this preferred embodiment, the ink drying device 150 is movable independently from the printing device 10. Therefore, it is easy to change the position of the ink drying device 150 with respect to the printing device 10. Thus, it is easy to fine-adjust the position of the ink drying device 150 with respect to the printing device 10.

In each of the above-described preferred embodiments, as shown in FIG. 7, the main body 51 of the ink drying device preferably is located above the downstream platen 17*c* of the platen 16. Alternatively, the main body 51 of the ink drying device may be located above the upstream platen 17*b* of the platen 16. In this case, the ink drying device may preliminarily heat the recording medium 5 placed on the upstream platen 17*b*. Since ink is injected toward the recording medium 5 heated preliminarily, the ink is easily dried.

In each of the above-described preferred embodiments, the heat diffusion layers 55*a* and 55*b* (see FIG. 8) are preferably defined by a heat diffusion paint. Alternatively, the heat diffusion layers 55*a* and 55*b* may each be a heat diffusion sheet or a heat diffusion plate. For example, the heat diffusion sheet may be a sheet containing a resin such as acrylic resin, polypropylene, silicone, polyolefin, urethane, epoxy resin or the like and a heat diffusion ceramic powder dispersed in the resin. In this case also, substantially the same effect as described above is provided.

In each of the above-described preferred embodiments, in the printing device 10, the carriage 30 is movable in the main scanning direction Y and the recording medium 5 placed on the platen 16 is movable in the sub scanning direction X. Neither the carriage 30 nor the recording medium 5 is limited to being movable in such a direction. The movement of the carriage 30 and the recording medium 5 is relative, and one of the carriage 30 and the recording medium 5 may move in the main scanning direction Y or the sub scanning direction X. For example, the recording medium 5 may be unmovable whereas the carriage 30 may be movable in both of the main scanning direction Y and the sub scanning direction X. Alternatively, both of the carriage 30 and the recording medium 5 may be movable in both of the directions.

The technology disclosed herein is applicable to printing systems including any of various types of printing device. The technology is applicable to printing systems including the above-described printing device 10, which is of a so-called roll-to-roll type, namely, printing devices that transports the rolled-type recording medium 5, and is also applicable to printing systems including, for example, flatbed-type inkjet printers. The printing device 10 is not limited to being a printer independently usable, and may be combined with another device. For example, the printing device 10 may be built in another device.

The components of the controller 80, namely, the storage processor 81, the initial control processor 82, the printing control processor 83, the first printing finish control processor and the second printing finish control processor 85 may be realized by software. Namely, each of the above-described components may be realized by a computer having a computer program incorporated thereto. The present invention encompasses a computer program that causes the computer to act as each of the above-described components. The present invention encompasses a computer-readable storage medium having the computer program stored thereon. The processors as the components of the controller 80 may be realized by the computer program stored on the controller 80 being executed. In this case, each component may include one processor or a plurality of processors. The present invention encompasses a circuit having substantially the same function as that of the program executable by each of the components.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink drying device that dries ink injected onto a recording medium, the ink drying device comprising:

a main body including a counter plate facing the recording medium and including an inner space and a plurality of discharge holes;

a heat generator located in the inner space of the main body to generate heat; and a heat diffusion layer provided on an outer surface of the counter plate facing the recording medium.

2. The ink drying device according to claim 1, further comprising another heat diffusion layer provided on an inner surface of the counter plate opposite to the outer surface.

3. The ink drying device according to claim 1, further comprising a leg extending downward from the main body.

4. The ink drying device according to claim 1, wherein the counter plate is located between the heat generator and the heat diffusion layer.

5. The ink drying device according to claim 1, wherein the heat diffusion layers include a heat diffusion paint.

6. The ink drying device according to claim 5, wherein the heat diffusion paint includes at least a metal oxide.

7. The ink drying device according to claim 1, wherein the heat generator includes:

a heat source case located in the main body and including an inner space;

a heat source located in the heat source case to generate heat; and a fan provided on the heat source case;

the heat source case is provided with a heat source-side discharge hole via which the heat generated by the heat source is discharged to the inner space of the main body; and the main body is provided with an absorption slit that communicates the fan and an outside of the main body to each other.

8. The ink drying device according to claim 7, wherein the main body includes a cover that encloses the inner space together with the counter plate;

the main body is provided with a discharge slit between the counter plate and the cover; and the main body is provided with a path in communication with the discharge slit to allow passage of a portion of the heat generated by the heat source.

9. The ink drying device according to claim 8, wherein the main body extends in a predetermined first direction;

the absorption slit is provided between the counter plate and one end among two ends of the cover in a second direction perpendicular or substantially perpendicular to the first direction as seen in a plan view; and the discharge slit is provided at the other end of the cover in the second direction.

10. The ink drying device according to claim 9, wherein the main body further includes a guide provided in the discharge slit and extending downward and toward the one end in the second direction.

11. The ink drying device according to claim 7, wherein the heat generator includes a driving motor connected with the fan;

the ink drying device further comprising:

a temperature sensor provided on the counter plate; and a controller communicably connected with the driving motor, the heat source and the temperature sensor;

the controller is configured or programmed to include:

an initial control processor that determines whether or not a detected temperature detected by the temperature sensor is no higher than a predetermined first temperature, and when the detected temperature is lower than, or equal to, the first temperature, controls the driving motor such that a rotation rate of the fan is a predetermined first rotation rate and controls the heat source such that an amount of the heat to be generated by the heat source is a predetermined first heat amount;

a printing control processor that, at a time of printing, controls the driving motor such that the rotation rate of the fan is a second rotation rate greater than the first rotation rate;

a first printing finish control processor that, at a time of finish of printing, stops heat generation by the heat source; and a second printing finish control processor that, after the heat generation by the heat source is stopped by the first printing finish control processor, determines whether or not the detected temperature detected by the temperature sensor is no higher than a second temperature lower than the first temperature, and when the detected temperature is lower than, or equal to, the second temperature, stops the driving motor to stop the fan.

12. A printing system, comprising:

the ink drying device according to claim 1; and a printing device including a carrying stand on which the recording medium is allowed to be placed, and an ink head that injects ink toward the carrying stand.

13. The printing system according to claim 12, further comprising a guide rail extending in a main scanning direction, the guide rail allowing the ink head to slide thereon; wherein the carrying stand extends in the main scanning direction; and the counter plate of the main body of the ink drying device extends in the main scanning direction.

14. The printing system according to claim 13, wherein the ink drying device is attached to the printing device such that the counter plate faces the carrying stand and is above the carrying stand.

15. The printing system according to claim 14, further comprising a medium transportation mechanism that transports the recording medium placed on the carrying stand in a sub scanning direction with respect to the ink head; wherein the ink drying device is located above one of two ends of the carrying stand in the sub scanning direction.

* * * * *